United States Patent [19]

Woodruff et al.

[11] 4,088,109

[45] May 9, 1978

[54] DIESEL ENGINE WARM-UP CONTROL SYSTEM

[75] Inventors: William C. Woodruff, St. Charles, Mo.; Dennis M. Lombardo, Warren; Theodore H. Horrell, Jr., Cortland, both of Ohio

[73] Assignee: General Motors Corporation, Detroit, Mich.

[21] Appl. No.: 772,241

[22] Filed: Feb. 25, 1977

[51] Int. Cl.[2] ..... F02N 17/00

[52] U.S. Cl. ..... 123/179 H; 123/179 B; 123/179 BG

[58] Field of Search ..... 123/145 A, 179 R, 179 B, 123/179 BG, 179 H; 290/37 R, 38 R

[56] References Cited

U.S. PATENT DOCUMENTS

| | | | |
|---|---|---|---|
| 2,552,256 | 5/1951 | Cerf | 123/179 B |
| 3,551,686 | 12/1970 | Koehler et al. | 123/179 H |
| 3,675,033 | 7/1972 | Richard et al. | 123/145 A |
| 3,691,393 | 9/1972 | Papachristou | 123/179 H |
| 3,708,683 | 1/1973 | Howland | 123/179 H |
| 4,024,408 | 5/1977 | Coleman et al. | 290/37 R |

*Primary Examiner*—Charles J. Myhre
*Assistant Examiner*—David D. Reynolds
*Attorney, Agent, or Firm*—Richard G. Stahr

[57] ABSTRACT

Upon the closing of the ignition circuit, this Diesel engine warm-up control system operates to establish a glow plug energizing circuit; to energize a "wait" indicator lamp and to produce a timed glow plug energization cycle signal. Upon the termination of this signal, the glow plug energizing circuit is maintained; the "wait" indicator lamp is deenergized and a "crank" indicator lamp is energized. The timed glow plug energization cycle signal is re-initiated upon engine crank to maintain the glow plugs energized for a controlled period of time after engine "start". A re-cycle feature which re-cycles the system in the event the engine does not start after crank, an automatic shutdown feature which deenergizes the glow plugs at the conclusion of the controlled period of time after the ignition circuit is closed in the event the engine is not cranked and a fast idle feature which provides engine fast idle during and for a predetermined time period after each cranking period at all engine temperatures are provided.

8 Claims, 2 Drawing Figures

DIESEL ENGINE WARM-UP CONTROL SYSTEM

Figure 1:
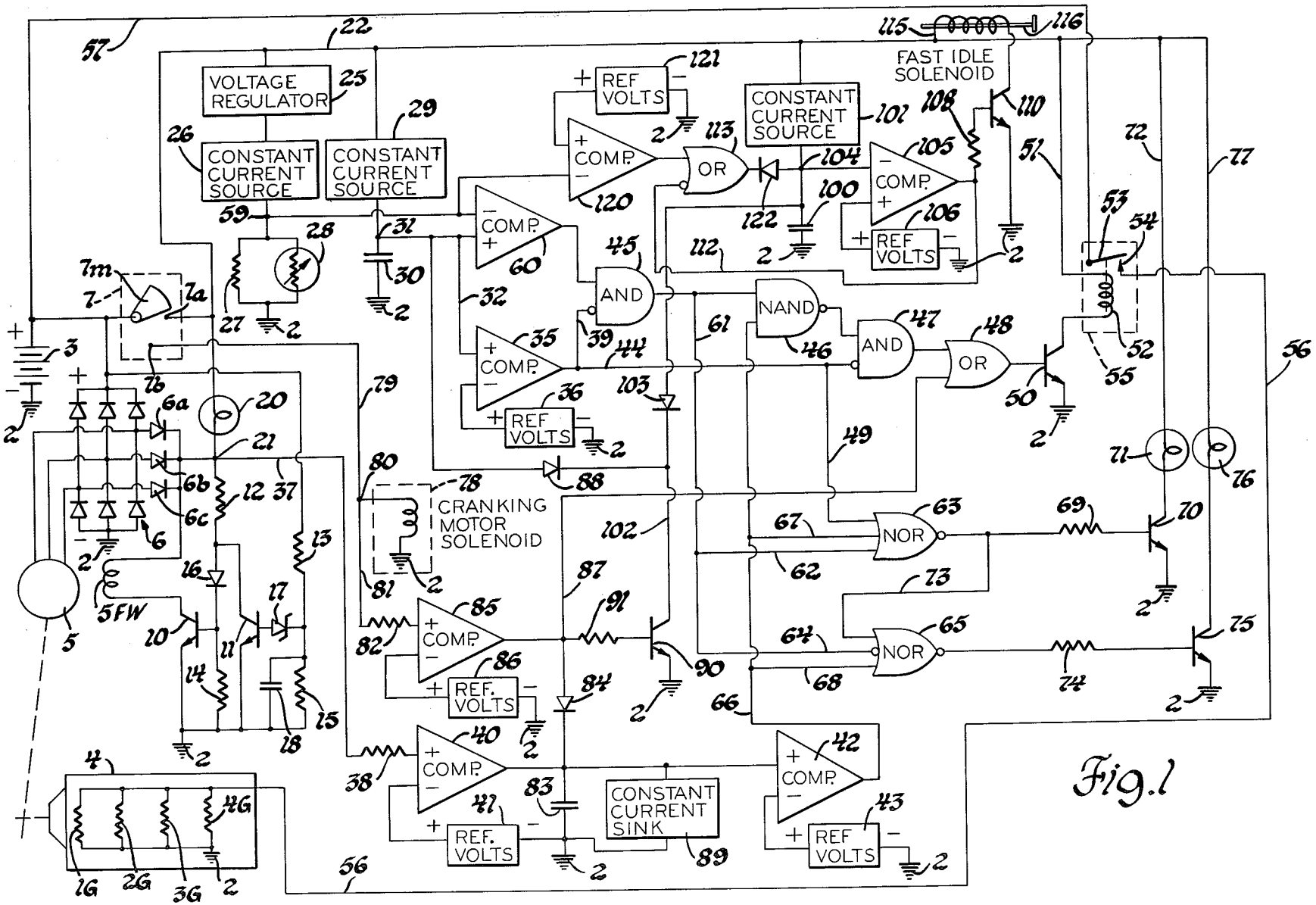

This invention is directed to a Diesel engine warm-up control system and, more specifically, to a Diesel engine warmup control system which provides periods of glow plug preglow and afterglow which are a function of engine temperature and system operating potential magnitude.

Diesel cycle engines are notoriously difficult to start, particularly with cold weather conditions. To expedite starting, therefore, glow plugs are generally employed. Glow plugs are electrically energizable devices which may be threaded into the engine block and include heater elements which are in communication with the combustion chamber. Upon the electrical energization of these devices, the heater elements are raised in temperature to preheat the combustion chamber prior to engine "crank". The period of time during which the glow plugs need be energized is determined by engine temperature and by system operating potential magnitude, the lower the engine temperature and/or the lower the operating potential magnitude, the longer the period of glow plug energization required. Furthermore, it is desirable that the glow plugs remain energized for a period of time after engine "start" subsequent to being cranked to provide satisfactory engine operation during the period required for the engine to come up to operating temperature. A desirable feature of a Diesel engine warm-up control system, therefore, is the provision of respective timed glow plug energization cycles of a duration which is a function of engine temperature and system operating potential magnitude before engine "crank" and after engine "start" subsequent to being cranked.

It is, therefore, an object of this invention to provide an improved Diesel engine warm-up control system.

It is another object of this invention to provide an improved Diesel engine warm-up control system which energizes the glow plugs prior to engine "crank" during a timed glow plug energization cycle which is a function of engine temperature and system operating potential.

It is another object of this invention to provide an improved Diesel engine warm-up control system which energizes the glow plugs during respective timed glow plug energization cycles before engine "crank" and after engine "start", both cycles being of a duration of time which is the same function of engine temperature and system operating system magnitude.

It is another object of this invention to provide an improved Diesel engine warm-up control system having a feature which provides for the re-cycling of the system in the event the engine does not start upon being cranked.

It is another object of this invention to provide an improved Diesel engine warm-up control system having an automatic shutdown feature which deenergizes the glow plugs and shuts the system down upon the termination of a predetermined period of time after the ignition switch has been closed in the event the engine is not cranked.

It is an additional object of this invention to provide an improved Diesel engine warm-up control system having an engine fast idle control feature which provides for engine fast idle during and for a predetermined time period after each cranking period and while the engine temperature is lower than a predetermined value.

In accordance with this invention, a Diesel engine warm-up control system is provided wherein the glow plugs are energized during respective timed glow plug energization cycles of a duration determined by engine temperature and system operating potential magnitude prior to engine start and after the engine is running subsequent to being cranked and which re-cycles in the event the engine does not start.

Figure 2:
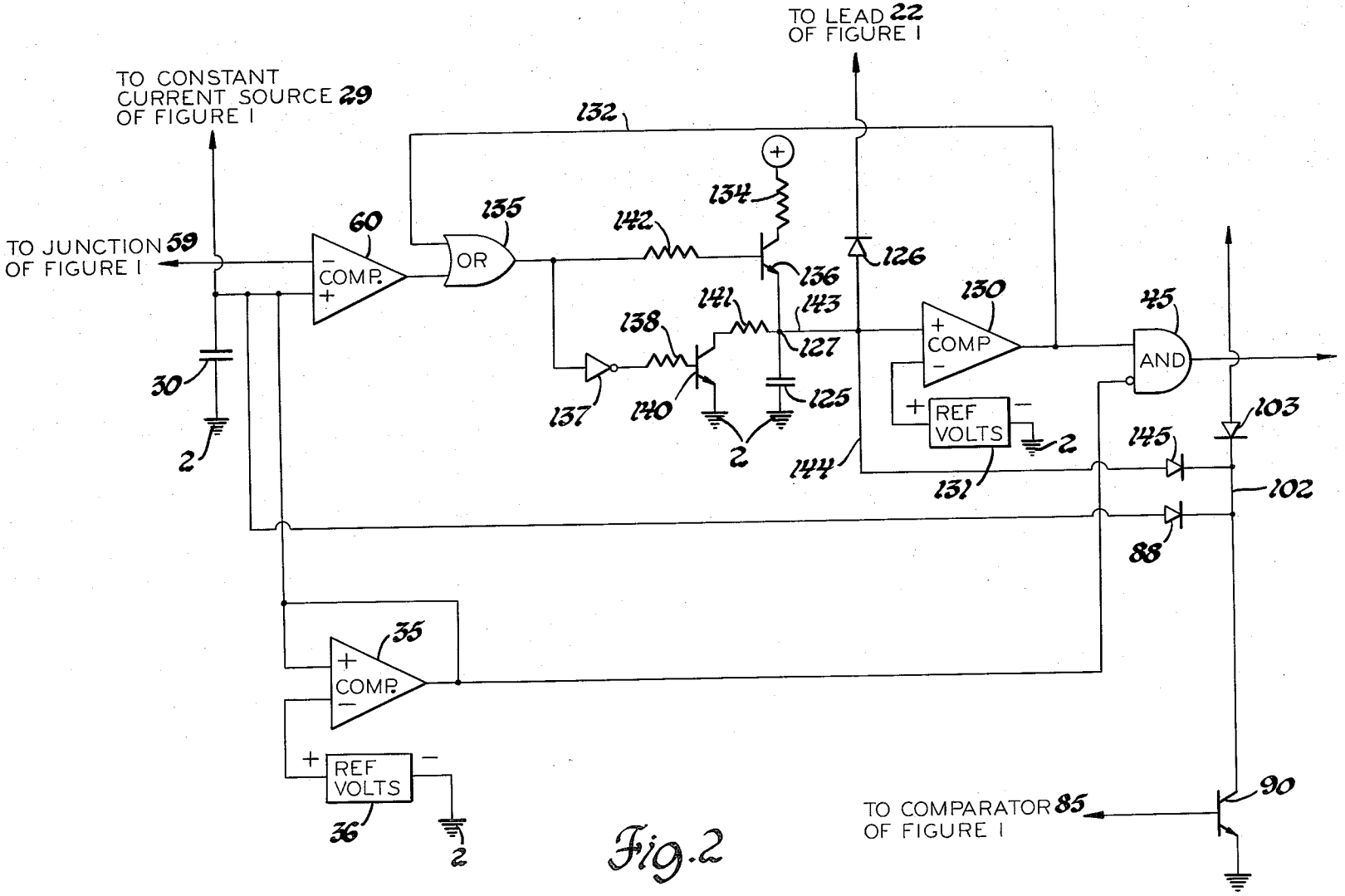

For a better understanding of the present invention, together with additional objects, advantages and features thereof, reference is made to the following description and accompanying drawing in which:

FIG. 1 sets forth partially in schematic and partially in block form the Diesel engine warm-up control system of this invention; and FIG. 2 sets forth partially in schematic and partially in block form a latch circuit arrangment which may be employed with the circuit of FIG. 1.

The Diesel engine warm-up control system of this invention employs conventional constant current sources, a constant current sink, potential comparator circuits, AND gates, NAND gates, NOR gates and OR gates. As these circuits and/or circuit elements may be of conventional circuit design or commercially available items well-known in the art and, per se, form no part of this invention, each has been illustrated in block form in the drawing. Furthermore, these devices are only examples of circuit elements suitable for use with the system of this invention, consequently, there is no intention or inference of a limitation thereto as other circuit elements having similar electrical characteristics may be substituted therefor without departing from the spirit of the invention.

In accordance with logic terminology well-known in the art, throughout this specification logic signals will be referred to as "high" or logic 1, or "low" or logic 0 signals. For purposes of this specification and without intention or inference of a limitation thereto, the "high" or logic 1 signals will be considered to be of a positive polarity potential and the "low" or logic 0 signals will be considered to be of zero or ground potential.

In FIGS. 1 and 2 of the drawing, like elements have been assigned like characters of reference and, since it is the same point electrically throughout the system, point of reference or ground potential has been respresented by the accepted schematic symbol and referenced by the numeral 2.

Referring to FIG. 1, the Diesel engine warm-up control system of this invention is set forth partially in schematic and partially in block form in combination with a source of system operating potential, which may be a conventional automotive type storage battery 3, and a Diesel engine 4. The Diesel engine 4 is indicated as having four glow plugs 1G, 2G, 3G and 4G connected in parallel, each corresponding to a respective engine 4 combustion chamber. For purposes of this specification, the warm-up control system of this invention will be described with regard to a four cylinder Diesel engine. It is to be specifically understood, however, that this system is also applicable to Diesel engines having more or less cylinders.

Engine 4 is arranged to drive a conventional automotive type alternator 5 in a manner well-known in the art. The three phase output potential of alternator 5 is full-wave rectified by a conventional six diode bridge type full-wave rectifier circuit 6 well-known in the art having a positive polarity output terminal connected to the positive polarity terminal of battery 3 and a negative polarity output terminal connected to point of reference or ground potential 2.

The positive polarity terminal of battery 3 is connected to the movable contact 7*m* of a conventional automotive type ignition switch 7 having in addition to movable contact 7*m* two stationary contacts 7*a* and 7*b*. Ignition switch 7 may be a conventional automotive type ignition switch having an "Off" position, in which position it is shown in FIG. 1, a "Crank" position in which movable contact 7*m* is in electrical contact with both stationary contacts 7*a* and 7*b* and a "Run" position in which movable contact 7*m* is in electrical contact with stationary contact 7*a*. Ignition switches of this type are normally spring biased to automatically return to the "Run" position from the "Crank" position upon the release of torque upon the ignition key, in a manner well-known in the automotive art. Alternatively, switch 7 may be any suitable electrical switch.

In the interest of reducing drawing complexity, specific operating potential connections to the circuit elements of FIGS. 1 and 2 have not been shown. It is to be specifically understood, however, that upon the closure of movable contact 7*m* of ignition switch 7 to stationary contact 7*a*, operating potential is supplied to the circuit elements of FIGS. 1 and 2 as required.

Associated with full-wave rectifier conduit 6 is a diode trio 6*a*, 6*b*, and 6*c* which provides the energizing current for alternator field winding 5FW through the current carrying electrodes of an NPN switching transistor 10 while this device is in the conductive mode. The circuitry including NPN switching transistor 10, control NPN transistor 11, resistors 12, 13, 14 and 15, diode 16, Zener diode 17 and filter capacitor 18 is a conventional voltage regulator circuit of a type well-known in the art. Briefly, while the output potential of rectifier circuit 6 is less than a predetermined magnitude, Zener diode 17 remains in the blocking state to maintain control transistor 11 not conductive through the current carrying electrodes thereof. While control transistor 11 is not conductive, the potential across resistor 14 is of a magnitude sufficient to trigger switching transistor 10 conductive through the collector-emitter electrodes to complete an energizing circuit for field winding 5FW of alternator 5. Should the output potential of rectifier circuit 6 increase to or above the predetermined magnitude, Zener diode 17 breaks down and conducts in a reverse direction to trigger control transistor 11 conductive through the current carrying electrodes thereof. While control transistor 11 is conductive, base-emitter drive current is diverted from switching transistor 10 to extinguish this device which interrupts the alternator field coil 5FW energizing circuit.

Electric lamp 20 is the charge indicator lamp well-known in the automotive art which illuminates while the alternator is not charging the battery. Upon the closure of movable contact 7*m* of ignition switch 7 to stationary contact 7*a* while engine 4 is not running, an energizing circuit for charge indicator lamp 20 is provided which may be traced from the positive polarity terminal of battery 3 through movable contact 7*m* and stationary contact 7*a* of switch 7, charge indicator lamp 20, field winding 5FW, the collector-emitter electrodes of switching transistor 10 and point of reference or ground potential 2 to the negative polarity terminal of battery 3. Consequently, charge indicator lamp 20 becomes illuminated to indicate alternator 5 is not charging battery 3. When engine 4 is cranked and starts to run, the output potential of alternator 5 builds up, consequently, the potential upon junction 21 increases to a magnitude substantially equal to that upon the positive polarity output terminal of full-wave rectifier circuit 6. At this time, substantially equal potential is applied to both terminals of charge indicator lamp 20, consequently, charge indicator lamp 20 extinguishes to indicate alternator 5 is charging battery 3. If desired, charge indicator lamp 20 may be fused.

Connected across positive polarity potential lead 22 and point of reference or ground potential 2 is a first circuit including voltage regulator 25, constant current source 26 and the parallel combination of resistor 27 and thermistor 28. Voltage regulator 25 may be a conventional voltage regulator circuit well-known in the art that provides a regulated direct current output potential of a substantially constant predetermined magnitude which is a selected fraction of normal system operating potential. Constant current source 26 may be any of the several constant current source circuits well-known in the art which supplies a substantially constant output current. Thermistor 28 may be a commercially available negative temperature coefficient thermistor well-known in the art which decreases in ohmic value with an increase of temperature. Thermistor 28 is mounted upon the block of engine 4 at a location at which it senses engine temperature. In the preferred embodiment, thermistor 28 is arranged to sense engine coolant temperature.

Also connected across positive polarity potential lead 22 and point of reference or ground potential 2 is constant current source 29 and glow time timing signal capacitor 30. Constant current source 29 also may be any one of the many constant current source circuits well-known in the art which provides a substantially constant output current.

Upon the initial closure of movable contact 7*m* of ignition switch 7 to stationary contact 7*a* prior to engine crank, the energizing circuit for charge indicator lamp 20 previously described is established; constant current source 26 begins supplying a substantially constant charge current through thermistor 28 and constant current source 29 supplies a substantially constant charge current to glow time timing signal capacitor 30. The potential upon junction 31 across glow time timing capacitor 30 is applied through lead 32 to the non-inverting input terminal of a conventional voltage comparator circuit 35, the inverting input terminal of which is connected to the positive polarity output terminal of reference potential source 36. The magnitude of the reference potential supplied by reference potential source 36 will be brought out later in this specification, however, upon the initial closure of movable contact 7*m* to stationary contact 7*a*, it is of a positive polarity potential magnitude greater than the positive polarity potential magnitude upon junction 31 with respect to point of reference or ground potential 2, consequently, comparator circuit 35 produces a logic 0 output signal. The potential upon junction 21, of a positive polarity with respect to point of reference or ground potential 2, is applied through lead 37 and input resistor 38 to the non-inverting input terminal of a conventional voltage comparator circuit 40, the inverting input terminal of which is connected to the positive polarity output terminal of reference potential source 41. The magnitude of the reference potential supplied by reference potential source 41 is selected to be a fraction of the operating potential magnitude, for example, one-half to three-fourths. In a practical application of the system of this invention, reference potential source 41 supplies a direct current reference potential of six volts. Upon the initial closure of movable contact *7m* of ignition switch 7 to stationary contact *7a* prior to engine crank, the potential upon junction 21 is of a magnitude much less than system operating potential, typically approximately one-fourth. As the reference potential supplied by reference potential source 41 and applied to the inverting input terminal of comparator circuit 40 is of a magnitude greater than that upon junction 21 at this time, comparator circuit 40 produces a logic 0 output signal. This logic 0 output signal is applied to the non-inverting input terminal of a conventional voltage comparator circuit 42, the inverting input terminal of which is connected to the positive polarity output terminal of reference potential source 43. The magnitude of the reference potential supplied by reference potential source 43 will be brought out later in this specification, however, at this time it is of a positive polarity potential magnitude greater than point of reference or ground potential 2. As the magnitude of the reference potential applied to the inverting input terminal comparator circuit 42 is greater than that of the logic 0 signal applied at this time to the non-inverting input terminal thereof, comparator circuit 42 produces a logic 0 output signal. The logic 0 output signal of comparator circuit 35 is applied to the inverting input terminal of a conventional two input AND gate 45 through lead 39 enable this device; to the inverting input terminal of a conventional two input AND gate 47 through lead 44 to enable this device and to one of the input terminals of a conventional three input NOR gate 63 through leads 44 and 49. The logic 0 output signal of comparator circuit 42 is applied to one of the input terminals of a conventional two input NAND gate 46 through lead 66 and to one of the input terminals of each of conventional three input NOR gates 63 and 65 through lead 66 and respective leads 67 and 68.

With a logic 0 signal present upon one of the input terminals thereof, NAND gate 46 produces a logic 1 output signal which is applied to the other one of the input terminals of conventional two input AND gate 47. As the logic 0 output signal of comparator circuit 35 is applied to the inverting input terminal of AND gate 47, AND gate 47 produces a logic 1 output signal which is applied to one of the input terminals of a conventional two input OR gate 48. With a logic 1 signal present upon one of the input terminals thereof, OR gate 48 produces a logic 1 output signal which provides base-emitter drive current for NPN transistor 50 to trigger this device conductive through the current carrying electrodes thereof. Upon the initiation of collector-emitter conduction through NPN transistor 50, an energizing circuit is completed for operating coil 52 of glow plug relay 55 which may be traced from the positive polarity terminal of battery 3, through movable contact *7m* and stationary contact *7a* of ignition switch 7, positive polarity potential lead 22, lead 51, operating coil 52, the collector-emitter electrodes of NPN transistor 50 and point of reference or ground potential 2 to the negative polarity terminal of battery 3. Upon the completion of this energizing circuit, movable contact 53 of glow plug relay 55 is operated into electrical contact with stationary contact 54 to complete an energizing circuit for parallel connected glow plugs 1G, 2G, 3G and 4G which may be traced from the positive polarity output terminal of battery 3, through lead 57, the closed contacts 53 and 54 of glow plug relay 55, lead 56, the glow plugs 1G, 2G, 3G, and 4G in parallel and point of reference or ground potential 2 to the negative polarity terminal of battery 3. In applications in which the glow plug energizing current exceeds the capacity of relay 55, one or more similar relays may be connected in parallel therewith and operated by transistor 50.

From this description, it is apparent that the NAND gate 46, AND gate 47 and OR gate 48 combination comprises an electrical circuit for effecting the completion of the glow plug energizing circuit upon the application of system operating potential through movable contact *7m* and stationary contact *7a* of ignition switch 7.

As has been brought out prevously, upon the operation of movable contact *7m* of ignition switch 7 to stationary contact *7a*, an energizing current is supplied through thermistor 28 by voltage regulator circuit 25 and constant current source 26 and a charge current is supplied to glow time timing capacitor 30 through constant current source 29. The engine temperature indicating electrical signal, of a positive polarity upon junction 59 with respect to point of reference or ground potential 2, is applied to the inverting input terminal of a conventional voltage comparator circuit 60 and the glow time electrical timing signal, which increases substantially linearly in potential magnitude with time at a slope determined by operating potential magnitude and is of a positive polarity upon junction 31 with respect to point of reference or ground potential 2, is applied to the non-inverting input terminal of comparator circuit 60. While the engine temperature indicating electrical signal upon juncton 59 is of a potential magnitude greater than that of the glow time electrical timing signal upon junction 31, comparator circuit 60 produces a logic 0 timed glow plug energization cycle output signal which is applied to the other one of the input terminals of AND gate 45. With a logic 0 signal present upon one of the input terminals thereof, AND gate 45 produces a logic 0 output signal which is applied to the other one of the input terminals of two input NAND gate 46; to one of the input terminals of conventional three input NOR gate 63 through leads 61 and 62 and to the inverting input terminal of conventional three input NOR gate 65 through leads 61 and 64.

The logic 0 output signal of AND gate 45 does not affect the output signal of NAND gate 46 as a logic 0 signal is already present upon the other input terminal thereof from comparator circuit 42 as previously described. At this time, NOR gate 63 has a logic 0 signal present upon one of its three input terminals through leads 44 and 49 from comparator circuit 35, a logic 0 signal present upon another one of its input terminals through leads 66 and 67 from comparator circuit 42 and a logic 0 signal present upon the third input terminal thereof through leads 61 and 62 from AND gate 45 and NOR gate 65 produces a logic 0 output signal in response to the logic 0 signal from AND gate 45 applied to the inverting input terminal thereof through leads 61 and 64. With a logic 0 signal present upon each of the three input terminals thereof, NOR gate 63 produces a logic 1 output signal which is applied through resistor 69 to the base electrode of NPN transistor 70 in the proper polarity relationship to produce base-emitter drive current through an NPN transistor. This base drive current triggers NPN transistor 70 conductive through the current carrying electrodes thereof to complete an energizing circuit for "Wait" indicator electric lamp 71 which may be traced from the positive polarity terminal of battery 3, through movable contact *7m* and stationary contact *7a* of ignition switch 7, positive polarity potential lead 22, lead 72, "Wait" indicator electric lamp 71, the collector-emitter electrodes of conducting NPN transistor 70 and point of reference or ground potential 2 to the negative polarity of battery 3.

When the potential magnitude of the glow time electrical timing signal appearing across junction 31 and point of reference or ground potential 2 rises to that of the engine temperature indicating electrical signal appearing across junction 59 and point of reference or ground potential 2, the output signal of comparator circuit 60 switches from a logic 0 to a logic 1 which is applied to one of the input terminals of AND gate 45. As the comparator circuit 35 logic 0 output signal is applied to the other inverting input terminal thereof, AND gate 45 produces a logic 1 output signal which is applied to one of the input terminals of NAND gate 46; to one of the input terminals of NOR gate 63 through leads 61 and 62 and to the inverting input terminal of NOR gate 65 through leads 61 and 64. This logic 1 signal does not affect the logic 1 output signal of NAND gate 46 as comparator circuit 42 still supplies a logic 0 signal to the other input terminal thereof. As a result of this logic 1 signal upon one of the input terminals thereof, NOR gate 63 produces a logic 0 output signal which extinguishes NPN transistor 70 to interrupt the energizing circuit previously described for "Wait" indicator electric lamp 71. At this time, NOR gate 65 has a logic 0 signal present upon one of its three input terminals through lead 73 from NOR gate 63, a logic 0 signal present upon another one of its input terminals through leads 66 and 68 from comparator circuit 42 and a logic 1 signal present upon the inverting input terminal thereof through leads 61 and 64 from AND gate 45. As a result of this input signal combination, NOR gate 65 produces a logic 1 output signal which is applied through resistor 74 to the base electrode of NPN transistor 75 in the proper polarity relationship to produce base-emitter drive current through an NPN transistor. This base drive current triggers NPN transistor 75 conductive through the current carrying electrodes thereof to complete an energizing circuit for "Crank" indicator electric lamp 76 through a circuit which may be traced from the positive polarity terminal of battery 3, through movable contact *7m* and stationary contact *7a* of ignition switch 7, positive polarity potential lead 22, lead 77, "Crank" indicator electric lamp 76, the collector-emitter electrodes of transistor 75 and point of reference or ground potential 2 to the negative polarity terminal of battery 3. The energization of "Crank" indicator electric lamp 76 indicates to the operator that the timed glow plug energization cycle has been completed and the engine may be cranked. Comparator circuit 60 and conventional AND gate 45, therefore, comprise circuitry which is responsive to the engine temperature indicating and glow time timing signals for producing a timed glow plug energization cycle output signal while the engine temperature indicating signal is of a potential magnitude greater than the glow time timing signal.

Upon the operation of movable contact *7m* of ignition switch 7 to the "Crank" position in which it is in electrical contact with stationary contacts *7a* and *7b*, the engine cranking motor solenoid 78 is energized from battery 3 through a circuit which may be traced from the positive polarity terminal of battery 3 through movable contact *7m* and stationary contact *7b* of ignition switch 7, lead 79, cranking motor solenoid 78 and point of reference or ground potential 2 to the negative polarity terminal of battery 3. While engine 4 is being cranked, a crank signal of a potential magnitude substantially equal to system operating potential appears across junction 80 and point of reference or ground potential 2 which is applied through lead 81 and input resistor 82 to the non-inverting input terminal of a conventional voltage comparator circuit 85, the inverting input terminal of which is connected to the positive polarity output terminal of a reference potential source 86. The magnitude of the reference potential supplied by reference potential source 86 is selected to be a fraction of operating potential magnitude, for example, one-half to three-fourths. In a practical application of the system of this invention, reference potential source 86 supplies a direct current reference potential of six volts. Upon the application of the crank signal to the non-inverting input terminal of comparator circuit 85, this device produces a logic 1 output signal. This logic 1 output signal charges capacitor 83 through diode 84, is applied through resistor 91 to the base electrode of NPN transistor 90 in the proper polarity relationship to produce base-emitter drive current through an NPN transistor to trigger this device conductive through the current carrying electrodes and is applied to the non-inverting input terminal of comparator circuit 42. Upon the conduction of NPN transistor 90, glow time timing signal capacitor 30 is discharged through diode 88 and the collector-emitter electrodes of NPN transistor 90 to reset the glow time timing signal to substantially zero to thereby enable comparator circuit 60 and AND gate 45 to effect the production of another timed glow plug energization cycle output signal in a manner previously described. When the charge upon capacitor 83 rises to a potential magnitude substantially equal to that of the reference potential applied to the inverting input terminal of comparator circuit 42, the output signal of comparator circuit 42 switches from a logic 0 to a logic 1 which is applied through circuitry previously described to one of the input terminals of NAND gate 46 and to one of the input terminals of each of NOR gates 63 and 65. As a result of this logic 1 signal present upon one of the input terminals thereof, NOR gate 65 produces a logic 0 output signal which extinguishes NPN transistor 75 to interrupt the "Crank" indicator electric lamp 76 energizing circuit previously described. The logic 1 output signal of comparator circuit 85 is also applied through lead 87 to one of the input terminals of OR gate 48. This device, therefore, produces a logic 1 output signal which maintains transistor 50 conductive through the current carrying electrodes thereof to maintain the glow plug energization circuit previously described established during the engine crank operation.

Assuming that the engine starts subsequent to being cranked, the charge upon capacitor 83 applied to the non-inverting input terminal of comparator circuit 42 maintains the logic 1 signal upon the output terminal thereof for a period of time determined by the discharge rate of constant current sink 89. Constant current sink 89 may be any of the many conventional constant current sink circuits well-known in the art. As the purpose of capacitor 83 is to maintain the potential upon the non-inverting terminal of comparator circuit 42 greater than that of the magnitude of the reference voltage supplied by source of reference potential 43 for a predetermined period of time to allow the potential of alternator 5 to build up to a point at which the potential upon junction 21 is of a magnitude greater than that of the reference potential supplied to the inverting input terminal of comparator circuit 40, the rate of discharge of capacitor 83 is designed relative to the magnitude of reference potential supplied to the inverting input terminal of comparator circuit 42 to provide this delay period of approximately two seconds. In a practical application of the system of this invention, reference potential source 43 supplies a direct current reference potential of 1.1 volts. When the potential upon junction 21 becomes equal to or greater than that of the reference potential applied to the inverting input terminal of comparator circuit 40 when the generator 5 output potential builds up to rated voltage, the output signal of comparator circuit 40 switches from a logic 0 to a logic 1 which is applied to the non-inverting input terminal of comparator circuit 42, a condition which maintains the logic 1 output signal upon the output terminal thereof. However, as the glow time timing signal had been reset to substantially zero, the output signal of comparator circuit 60 is a logic 0 and, consequently, the output signal of AND gate 45 is a logic 0 which is applied to the other one of the input terminals of NAND gate 46, a condition which results in a logic 1 output signal therefrom. In a manner previously explained, this logic 1 output signal is applied through AND gate 47 to OR gate 48 to maintain NPN transistor 50 conductive thereby maintaining the glow plug energizing circuit previously described. Upon the removal of the crank signal upon the termination of the crank mode, the glow time elecrical timing signal, the charge upon glow time timing capacitor 30, again builds up linearly in potential magnitude with time at a slope determined by operating potential magnitude appearing across positive polarity lead 22 and point of reference or ground potential 2. When the potential magnitude of the glow time electrical timing signal rises to that of the engine temperature indicating electrical signal, the output signal of comparator circuit 60 switches from a logic 0 to a logic 1 which is applied to one of the input terminals of AND gate 45 in a manner previously described. As the comparator circuit 35 logic 0 output signal is applied to the other inverting terminal thereof, AND gate 45 produces a logic 1 signal which is applied to one of the input terminals of NAND gate 46. As the comparator circuit 42 logic 1 output signal is present upon the other input terminal of NAND gate 46, this device produces a logic 0 output signal which is applied to one of the input terminals of AND gate 47. With a logic 0 signal present upon one of the input terminals thereof, AND gate 47 produces a logic 0 output signal which is applied to one of the input terminals of OR gate 48. As a logic 0 is also present upon the other input terminal of OR gate 48, the crank signal being no longer present, OR gate 48 produces a logic 0 output signal which extinguishes NPN transistor 50 to interrupt the energizing circuit previously described for operating coil 52 of glow plug relay 55. As a consequence, the energizing circuit previously described for the flow plugs of engine 4 is interrupted and the engine is in the running mode.

As thermistor device 28 is a negative temperature coefficient type mounted upon the engine block at a location convenient to sense engine temperature and is energized by a substantially constant regulated voltage through a constant current source, the engine temperature indicating electrical signal appearing across junction 59 and point of reference or ground potential 2 is of a potential magnitude inversely related to engine temperature. That is, the lower the temperature of engine 4, the greater is the potential magnitude of the engine temperature indicating electrical signal and, as engine temperature increases, the potential magnitude of the engine temperature indicating electrical signal decreases at a rate determined by the temperature-resistance characteristics of the device selected as thermistor 28. As thermistor 28 is energized by a regulated potential source of a magnitude less than that of the system operating potential, thermistor 28 is energized by a substantially constant potential over a wide range of system operating potential magnitude. Glow time timing capacitor 30, however, is charged by system operating potential magnitude through a constant current source 29. Consequently, the rate at which glow time timing capacitor 30 becomes charged is determined by operating potential magnitude. This is, the glow time electrical timing signal, the charge upon glow time timing capacitor 30, increases substantially linearly in potential magnitude with time at a slope determined by operating potential magnitude. As comparator circuit 60 is responsive to both these signals and, in conjunction with AND gate 45, produces a timed glow plug energization cycle output signal while the engine temperature indicating signal is of a potential magnitude greater than the glow time timing signal, the duration of each timed glow plug energization cycle is a function of engine temperature and system operating potential magnitude.

In the event the engine does not start subsequent to being cranked, the engine running signal does not appear across junction 21 and point of reference or ground potential 2. Consequently, after a time duration as determined by the discharge rate of capacitor 83 and the reference potential magnitude applied to the inverting input terminal of comparator circuit 42, the potential magnitude upon the non-inverting input terminal of comparator circuit 42 becomes less than that of the reference potential applied to the inverting input terminal. When the charge upon capacitor 83 has decreased to a magnitude less than that of the reference potential supplied by reference potential source 43, the output signal of comparator circuit 42 switches from a logic 1 to a logic 0 which is applied through circuitry previously described to NOR gates 63 and 65 and NAND gate 46. In a manner previously explained, with a logic 0 signal present upon one of the input terminals of NAND gate 46, the NAND gate 46, AND gate 47 and OR gate 48 combination effects the completion of the glow plug energizing circuit previously described. As the glow time electrical timing signal was reset to substantially zero in response to the engine crank signal, the output of AND gate 45 is a logic 0 which is applied to the other one of the input terminals of NAND gate 46, to one of the input terminals of NOR gate 63 and to the inverting input terminal of NOR gate 65. As a consequence, NOR gate 63 produces a logic 1 output signal which triggers transistor 70 conductive through the current carrying electrodes thereof to complete the energizing circuit previously described for "Wait" indicator electric lamp 71 and the system is reset to the point at which it will recycle as hereinabove described.

In the event engine 4 is not cranked after the "Crank" engine indicator electric lamp 76 has illuminated in a manner previously explained, the charge upon glow time timing capacitor 30 continues to build up. This potential is applied through lead 32 to the non-inverting input terminal of conventional voltage comparator circuit 35. When the magnitude of the potential charge upon glow time timing capacitor 30 is equal to or greater than that supplied to the inverting input terminal of comparator circuit 35 by source of reference potential 36, the output signal of comparator circuit 35 switches from a logic 0 to a logic 1 which is applied to the inverting input terminals of AND gates 45 and 47 and to one of the input terminals of NOR gate 63. With a logic 1 signal applied to the inverting input terminal thereof, AND gate 45 produces a logic 0 output signal which is applied to the inverting input terminal of NOR gate 65. With a logic 1 signal applied to the inverting input terminal thereof, NOR gate 65 produces a logic 0 output signal which extinguishes transistor 75 to interrupt the energizing circuit previously described for "Crank" indicator electric lamp 76. Also, with a logic 1 signal applied to the inverting input terminal thereof, AND gate 47 produces a logic 0 output signal. In the absence of the crank signal, a logic 0 signal is present upon both input terminals of OR gate 48 which produces a logic 0 output signal. This logic 0 output signal extinguishes NPN transistor 50 to interrupt the energizing circuit for operating coil 52 of glow plug relay 55, a condition which interrupts the glow plug energizing circuit previously described. With the comparator circuit 35 logic 1 output signal applied to one of the input terminals thereof, NOR gate 63 produces a logic 0 which maintains transistor 70 not conductive to interrupt the energizing circuit previously described for "Wait" indicator electric lamp 71. From this description, it is apparent that should the engine be not cranked for a selected period of time after the "Crank" indicator electric lamp 76 has been illuminated, comparator circuit 35 is responsive to the charge upon glow time timing capacitor 30 for producing a system shutdown signal at the conclusion of a predetermined period of time. This predetermined period of time is established by the charge rate of glow time timing capacitor 30 relative to the magnitude of the reference potential applied to the inverting input terminal of comparator circuit 35. In a practical application of the system of this invention, reference potential source 36 provides a reference potential magnitude of 6.3 volts.

The Diesel engine warm-up control system of this invention also includes a fast idle feature which provides for fast engine idle during each crank mode; while the engine temperature is less than a predetermined value and for a predetermined fast idle delay period following each crank mode when the engine temperature is greater than the predetermined value. With engine temperatures less than the predetermined value, the fast idle delay feature is ineffective. The fast idle delay period of time is provided by a fast idle delay capacitor 100 which is charged through a conventional constant current source 101. Upon the operation of movable contact *7m* of ignition switch 7 to the "Crank" position in which it is in electrical contact with stationary contact *7b*, the crank signal appears across junction 80 and point of reference or ground potential 2. In response thereto in a manner previously explained, comparator circuit 85 produces a logic 1 output signal which is applied to the base electrode of NPN transistor 90 in the proper polarity relationship to produce base-emitter drive current through an NPN transistor which triggers transistor 90 conductive through the current carrying electrodes thereof. Fast idle delay capacitor 100, therefore, discharges through lead 102, diode 103 and the collector-emitter electrodes of transistor 90 upon the initiation of each crank. The charge potential of fast idle delay capacitor 100 appears across junction 104 and point of reference or ground potential 2 and is applied to the inverting input terminal of a conventional voltage comparator circuit 105, the non-inverting input terminal of which is connected to the positive polarity output terminal of reference potential source 106. With a logic 0 signal present upon the inverting input terminal thereof as a result of the discharge of fast idle delay capacitor 100 upon the initiation of a crank mode, comparator circuit 105 produces a logic 1 output signal which is applied through resistor 108 to the base electrode of NPN transistor 110 in the proper polarity relationship to produce base-emitter drive current through an NPN transistor and is applied through lead 112 to the inverting input terminal of a conventional two input OR gate 113. The base-emitter drive current produced by the comparator circuit 105 logic 1 output signal triggers NPN transistor 110 conductive through the current carrying electrodes thereof to complete an energizing circuit for fast idle solenoid 115 through a circuit which may be traced from the positive polarity terminal of battery 3, through the closed contacts *7m* and *7b* of ignition switch 7, positive polarity potential lead 22, fast idle solenoid 115, the collector-emitter electrodes of transistor 110 and point of reference or ground potential 2 to the negative polarity terminal of battery 3. The armature 116 of fast idle solenoid 115 is mechanically connected to the engine 4 fast idle control mechanism in a manner well known in the Diesel engine art. Upon the completion of this energizing circuit, the armature 116 of fast idle solenoid 115 is operated in the direction to operate the engine fast idle control mechanism, not shown, in a manner to provide engine fast idle. The engine temperature indicating electrical signal appearing across junction 59 and point of reference or ground potential 2 is applied to the inverting input terminal of a conventional voltage comparator circuit 120, the non-inverting input terminal of which is connected to the positive polarity output terminal of reference potential source 121. While the engine temperature is less than the predetermined value, the potential magnitude of the engine temperature indicating electrical signal is greater than that of the reference potential applied to the non-inverting input terminal of comparator circuit 120. Consequently, with engine temperatures less than the predetermined value, comparator circuit 120 produces a logic 0 output signal which is applied to the other one of the input terminals of conventional two input OR gate 113. With a logic 1 signal applied to the inverting input terminal thereof as a result of the discharge of fast idle delay capacitor 100 upon the initiation of a crank mode as previously explained and a logic 0 signal applied to the other input terminal thereof, OR gate 113 produces a logic 0 output signal. The logic 0 output signal of OR gate 113 diverts the fast idle delay capacitor 100 charge current to point of reference or ground potential 2, thereby maintaining a logic 0 signal upon junction 104. With a logic 0 signal upon junction 104, voltage comparator circuit 105 produces a logic 1 output signal to maintain transistor 110 conductive. While engine temperature is less than the predetermined value, therefore, the fast idle solenoid 115 energizing circuit previously described is maintained. While engine temperature is greater than the predetermined value, the potential magnitude of the engine temperature indicating signal is less than that of the reference potential applied to the non-inverting input terminal of comparator circuit 120. Consequently, with engine temperatures greater than the predetermined value, comparator circuit 120 produces a logic 1 output signal which is applied to one of the input terminals of OR gate 113. With a logic 1 signal applied to one of the input terminals thereof, OR gate 113 produces a logic 1 output signal which reverse biases diode 122, a condition which allows constant current source 101 to charge fast idle delay capacitor 100. When the charge upon fast idle delay capacitor increases to a potential magnitude substantially equal to that of the reference potential applied to the non-inverting input terminal of comparator circuit 105, comparator circuit 105 produces a logic 0 output signal which extinguishes NPN transistor 110 to interrupt the energizing circuit previously described for fast idle solenoid 115. While engine temperature is greater than the predetermined value, therefore, the fast idle solenoid 115 energizing circuit is interrupted. To provide for the interruption of the fast idle solenoid 115 energizing circuit when engine temperature reaches the predetermined value after start, the magnitude of the reference potential supplied by reference potential source 121 is selected to be of a magnitude substantially equal to the magnitude of the engine temperature indicating electrical signal when engine temperature is equal to the predetermined value, the temperature at which the fast idle feature is to be deactivated. In a practical application of the system of this invention, reference potential source 121 provides a direct current reference potential of 5.0 volts. Should engine temperature be equal to or greater than the predetermined value upon engine start after a crank mode, the magnitude of the engine temperature indicating signal potential is of a value less than that of the reference potential applied to the non-inverting input terminal of comparator circuit 120. Comparator circuit 120, therefore, produces a logic 1 output signal which is applied to one of the input terminals of OR gate 113. With a logic 1 signal applied to one of the input terminals thereof, OR gate 113 produces a logic 1 output signal which reverse biases diode 122, a condition which allows constant current source 101 to charge fast idle delay capacitor 100. When the charge upon fast idle delay capacitor increases to a potential magnitude substantially equal to that of the reference potential applied to the non-inverting input terminal of comparator circuit 105, comparator circuit 105 produces a logic 0 output signal which extinguishes NPN transistor 110 to interrupt the energizing circuit previously described for fast idle solenoid 115. This engine fast idle delay period at the termination of a crank mode with the engine temperature equal to or greater than the predetermined value is determined by the charge rate of fast idle delay capacitor 100 and the magnitude of the reference potential applied to the non-inverting input terminal of comparator circuit 105. In a practical application of the system of this invention, reference potential source 106 supplies a direct current reference potential of 5.6 volts which provide a fast idle delay period of approximately 8 seconds ± 4 seconds. Should the engine temperature be less than the predetermined value at the conclusion of any crank mode, a logic 0 signal would be maintained upon junction 104 as previously described. With engine temperatures less than the predetermined value, therefore, the fast idle delay feature is ineffective. From this description, it is apparent that the comparator circuit 120, OR gate 113 and comparator circuit 105 circuit combination is responsive to the engine temperature indicating signal for producing a fast idle signal while the temperature of the engine is less than a predetermined value.

With some applications, it may be desirable to include latch circuitry between comparator circuit 60 and AND gate 45 and also a latch provision for comparator circuit 35. This latch circuitry feature is set forth in detail in FIG. 2.

Referring to FIG. 2, latch capacitor 125 discharges to a low potential through diode 126, the anode of which is connected to positive polarity potential lead 22. While ignition switch 7 is in the "Off" position, one discharge circuit for latch capacitor 125 is through charge indicator electric lamp 20, FIG. 1, resistor 12, diode 16 and resistor 14 to point of reference or ground potential 2. Upon the closure of movable contact **7*m* of ignition switch 7 to stationary contact 7*a*, the magnitude of the potential upon junction 127 applied to the non-inverting input terminal of a conventional voltage comparator circuit 130 is less than the reference potential magnitude upon the inverting input terminal thereof which is connected to the positive polarity output terminal of reference potential source 131. Comparator circuit 130, therefore, produces a logic 0 output signal which is applied through lead 132 to one of the input terminals of a conventional two input OR gate 135. The output signal of comparator circuit 60 is applied to the other input terminal of OR gate 135, therefore, while the output signal of comparator circuit 60 is a logic 0 for the period of the timed glow plug energization cycle signal, OR gate 135 produces a logic 0 output signal which is applied to the base electrode of NPN transistor 136 and through conventional inverter circuit 137 and input resistor 138 to the base electrode of NPN transistor 140. While the output signal of OR gate 135 is a logic 0, this signal is inverted by inverter circuit 137 to a logic 1 signal which produces base-emitter drive current through NPN transistor 140. This base-emitter drive current triggers transistor 140 conductive through the current carrying electrodes thereof to maintain latch capacitor 125 substantially in a discharged state through resistor 141. When the output signal of comparator circuit 60 switches from a logic 0 to a logic 1 in response to the glow time timing signal rising to a potential magnitude equal to that of the engine temperature indicating signal in a manner previously described, OR gate 135 produces a logic 1 output signal. This logic 1 output signal is inverted to a logic 0 signal by inverter circuit 137 to extinguish transistor 140 and is applied to the base electrode of NPN transistor 136 through resistor 142 in the proper polarity relationship to produce base-emitter drive current through an NPN transistor. This base-emitter drive current triggers NPN transistor 136 conductive through the current carrying electrodes to supply charge current through collector resistor 134 and the collector-emitter electrodes thereof to charge latch capacitor 125. When the potential upon junction 127, the charge upon latch capacitor 125, rises to a magnitude equal to that of the reference potential applied to the inverting input terminal of comparator circuit 130, comparator circuit 130 produces a logic 1 output signal which is applied to one of the input terminals of AND gate 45. The logic 1 output signal of comparator circuit is also applied through lead 132 to the other one of the input terminals of OR gate 135 to maintain a logic 1 upon the output terminal thereof which maintains transistor 136** conductive regardless of any line disturbances which may occur. The remainder of the circuit operates in a manner previously explained.

The latch capacitor 125 is reset upon the occurrence of the logic 1 output signal of comparator circuit 85 in response to an engine crank signal, as previously explained. This logic 1 signal is applied to the base-emitter electrodes of NPN transistor 90 in the proper polarity relationship to produce base-emitter drive current through an NPN transistor. Consequently, NPN transistor 90 is triggered conductive through the current carrying electrodes thereof to provide a discharge circuit for latch capacitor 125 which may be traced from junction 127, through leads 143 and 144, diode 145, lead 102, the collector-emitter electrodes of transister 90 and point of reference or ground potential 2 to the other side of latch capacitor 125.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A Diesel enging warm-up control system for use with Diesel engines having at least one engine glow plug comprising in combination with a source of system operating potential: first circuit means for effecting the completion of a glow plug energizing circuit; means including a source of regulated direct current potential for producing an electrical engine temperature indicating signal of a potential magnitude inversely related to engine temperature; means for producing an electrical glow time timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means for producing a crank signal while said engine is being cranked; means responsive to said crank signal for resetting said glow time timing signal to substantially zero thereby enabling said second circuit means to effect the production of another timed glow plug energization cycle output signal; means for producing an engine running signal while said engine is in the running mode subsequent to being cranked; and means included in said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal.

2. A Diesel engine warm-up control system for use with Diesel engines having at least one engine glow plug comprising in combination with a source of system operating potential and an electrically energizable "crank engine" indicating device: first circuit means for effecting the completion of a glow plug energizing circuit; means including a source of regulated direct current potential for producing an electrical engine temperature indicating signal of a potential magnitude inversely related to engine temperature; means for producing an electrical glow time timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means responsive to the termination of said timed glow plug energization cycle signal for effecting the completion of an energizing circuit for said "crank engine" indicating device; means for producing a crank signal while said engine is being cranked; means responsive to said crank signal for resetting said glow time timing signal to substantially zero thereby enabling said second circuit means to effect the production of another timed glow plug energization cycle output signal; means for producing an engine running signal while said engine is in the running mode subsequent to being cranked; and means included in said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal.

3. A Diesel engine warm-up control system for use with Diesel engines having at least one engine glow plug comprising in combination with a source of system operating potential and an electrically energizable "crank engine" indicating device: first circuit means including at least a logic gate combination for effecting the completion of a glow plug energizing circuit; means including a source of regulated direct current potential for producing an electrical engine temperature indicating signal of a potential magnitude inversely related to engine temperature; means for producing an electrical glow time timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means responsive to the termination of said timed glow plug energization cycle signal for effecting the completion of an energizing circuit for said "crank engine" indicating device; means for producing a crank signal while said engine is being cranked; means responsive to said crank signal for resetting said glow time timing signal to substantially zero thereby enabling said second circuit means to effect the production of another timed glow plug energization cycle output signal; means for producing an engine running signal while said engine is in the running mode subsequent to being cranked; and means for applying said engine running signal and said timed glow plug energization cycle signal to said logic gate combination of said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal.

4. A Diesel engine warm-up control system for use with Diesel engines having at least one engine glow plug comprising in combination with a source of system operating potential and an electrically energizable "crank engine" indicating device: first circuit means including at least a first logic gate combination for effecting the completion of a glow plug energizing circuit; means including a source of regulated direct current potential for producing an electrical engine temperature indicating signal of a potential magnitude inversely related to engine temperature; means for producing an electrical glow time timing signal which changes in potential magnitude with time at a rate determined by operating potential magnitude; second circuit means including at least a voltage comparator circuit responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means including a second logic gate combination and an electrically operable switching device responsive to the termination of said timed glow plug energization cycle signal for effecting the completion of an energizing circuit for said "crank engine" indicating device; means for producing a crank signal while said engine is being cranked; means responsive to said crank signals for resetting said glow time timing signal to substantially zero thereby enabling said second circuit means to effect the production of another timed glow plug energization cycle output signal; means for producing an engine running signal while said engine is in the running mode subsequent to being cranked; and means for applying said engine running signal and said timed glow plug energization cycle signal to said first logic gate combination of said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal.

5. A Diesel engine warm-up control system for use with Diesel engines having at least one engine glow plug comprising in combination with a source of system operating potential, a source of regulated potential, first and second constant current sources and an electrically energizable "crank engine" indicating device: first circuit means including at least a first logic gate combination for effecting the completion of a glow plug energizing circuit; means including a negative temperature coefficient thermistor device mounted upon said engine and energized by said source of regulated potential through a selected one of said constant current sources for producing an electrical engine temperature indicating signal of a potential magnitude inversely related to engine temperature; a glow time timing signal capacitor energized by said source of system operating potential through the other one of said constant current sources for producing an electrical glow time timing signal which changes in potential magnitude with time at a rate determined by operating potential magnitude; second circuit means including at least a voltage comparator circuit responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means including a second logic gate combination and an electrically operable switching device responsive to the termination of said timed glow plug energization cycle signal for effecting the completion of an energizing circuit for said "crank engine" indicating device; means for producing a crank signal while said engine is being cranked; means including a first voltage comparator circuit and a transistor controlled thereby responsive to said crank signal for discharging said glow time timing signal capacitor to substantially zero potential thereby enabling said second circuit means to effect the production of another timed glow plug energization cycle output signal; means including a second voltage comparator circuit for producing an engine running signal while said engine is in the running mode subsequent to being cranked; and means for applying said engine running signal and said timed glow plug energization cycle signal to said logic rate combination of said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal.

6. A Diesel engine warm-up control system for use with Diesel engines having at least one engine glow plug comprising in combination with a source of system operating potential and an electrically energizable "crank engine" indicating device: first circuit means including at least a first logic gate combination for effecting the completion of a glow plug energizing circuit; means including a sorce of regulated direct current potential for producing an electrical engine temperature indicating signal of a potential magnitude inversely related to engine temperature; means for producing a glow time electrical timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means responsive to the termination of said timed glow plug energization cycle signal for effecting the completion of an energizing circuit for said "crank engine" indicating device; means for producing a crank signal while said engine is being cranked; means responsive to said crank signal for resetting said glow time timing signal to substantially zero thereby enabling said second circuit means to effect the production of another timed glow plug energization cycle output signal; means for producing a recycle signal a predetermined period of time after said engine has been cranked and has not started; and means for applying said recycle signal to said logic gate combination of said first circuit means for enabling said first circuit means to complete said glow plug energizing circuit.

7. A Diesel engine warm-up control system for use with Diesel engines having at least one engine glow plug comprising in combination with a source of system operating potential and an electrically energizable "crank engine" indicating device: first circuit means for effecting the completion of a glow plug energizing circuit; means including a source of regulated direct current potential for producing an electrical engine temperature indicating signal of a potential magnitude inversely related to engine temperature; means for producing a glow time electrical timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means responsive to the termination of said timed glow plug energization cycle signal for effecting the completion of an energizing circuit for said "crank engine" indicating device; means responsive to said glow time timing signal for producing a system shut-down signal in the event said engine has not been cranked at the conclusion of a predetermined period of time; and means included in said first circuit means and responsive to said shut-down signal for disabling said first circuit means and thereby effecting the interruption of said glow plug energizing circuit.

8. A Diesel engine warm-up control system for use with Diesel engines having at least one engine glow plug comprising in combination with a source of system operating potential and an electrically energizable "crank engine" indicating device: first circuit means for effecting the completion of a glow plug energizing circuit; means including a source of regulated direct current potential for producing an electrical engine temperature indicating signal of a potential magnitude inversely related to engine temperature; means for producing a glow time electrical timing signal which changes in potential magnitude with time at a rate determined by operating potential magnitude; second circuit means responsive to said engine temperature indicating and glow time timing signals for producing a timed glow plug energization cycle output signal while said engine temperature indicating signal is of a potential magnitude greater than said glow time timing signal whereby the duration of each glow plug energization cycle is a function of engine temperature and system operating potential magnitude; means responsive to the termination of said timed glow plug energization cycle signal for effecting the completion of an energizing circuit for said "crank engine" indicating device; means for producing a crank signal while said engine is being cranked; means responsive to said crank signal for resetting said glow time timing signal to substantially zero thereby enabling said second circuit means to effect the production of another timed glow plug energization cycle output signal; means for producing an engine running signal while said engine is in the running mode subsequent to being cranked; means included in said first circuit means for disabling said first circuit means and thereby effecting the interruption of said glow plug energizing circuit in response to the presence of said engine running signal and the termination of the said timed glow plug energization cycle signal produced by said second circuit means after said glow time timing signal was reset to substantially zero in response to said crank signal; and means responsive to said engine temperature indicating signal for producing a fast idle signal when the temperature of said engine is less than a predetermined number of degrees.

* * * * *

UNITED STATES PATENT AND TRADEMARK OFFICE

CERTIFICATE OF CORRECTION

PATENT NO. : 4,088,109

DATED : May 9, 1978

INVENTOR(S) : William C. Woodruff, Dennis M. Lombardo, Theodore H. Horrell, Jr.

It is certified that error appears in the above-identified patent and that said Letters Patent are hereby corrected as shown below:

Column 9, line 59, "flow" should read -- glow --.

Column 10, line 17, "This is" should read -- That is --

Claim 6, column 18, line 43, "sorce" should read -- source --.

Signed and Sealed this

*Third* Day of *April 1979*

[SEAL]

*Attest:*

RUTH C. MASON
*Attesting Officer*

DONALD W. BANNER
*Commissioner of Patents and Trademarks*